United States Patent [19]

Kohn

[11] 4,124,390

[45] Nov. 7, 1978

[54] DYE TONING SYSTEM

[75] Inventor: Victor E. Kohn, Westbury, N.Y.

[73] Assignee: Recognition Systems, Inc., Port Washington, N.Y.

[21] Appl. No.: 736,768

[22] Filed: Oct. 29, 1976

[51] Int. Cl.[2] ..... G03C 7/00; G03C 5/32

[52] U.S. Cl. ..... 96/57; 96/51; 96/60 R; 96/60 BF

[58] Field of Search ..... 96/51, 57, 60, 60 BF

[56] References Cited

U.S. PATENT DOCUMENTS

| | | | |
|---|---|---|---|
| 1,303,506 | 5/1919 | Shorrocks | 96/57 |
| 1,868,085 | 7/1932 | Whitehorne | 96/57 |
| 2,108,261 | 2/1938 | Jamieson | 96/60 R |
| 2,206,190 | 7/1940 | Jamieson | 96/60 R |
| 2,318,818 | 5/1943 | Tull | 96/57 |
| 3,642,478 | 2/1972 | Brault | 96/51 |

FOREIGN PATENT DOCUMENTS

| | | | |
|---|---|---|---|
| 160,540 | 3/1921 | United Kingdom | 96/57 |

OTHER PUBLICATIONS

Clerc, Photography: Theory & Practice p. 377, 2nd edition, 1937.

Photo Lab Index, 1971, p. 3-260.

*Primary Examiner*—Mary F. Kelley

*Attorney, Agent, or Firm*—Darby & Darby

[57] ABSTRACT

Disclosed herein is a system for selectively mordanting a dye to preselected areas of a black and white photographic silver image and rapidly removing all traces of the dye from the non-image areas. The system includes novel processing compositions to enable the entire process to be carried out rapidly with a minimum amount of equipment.

26 Claims, No Drawings

DYE TONING SYSTEM

This invention relates to a dye toning system. More specifically, the invention deals with an integrated system for rapidly mordanting and dyeing preselected areas of a photographic silver image and removing all traces of the dye from the non-image areas.

The process of dye toning has been known in the photographic arts for many years. In general, dye toning is accomplished by transforming the silver of a photographic image into a variety of other insoluble stable compounds which have the property of uniting with various dyes. The unification of the dye with the insoluble compounds is commonly termed mordanting and has been used as the basis of dye toning systems for many years. Prior art mordanting systems are fairly complex operations, requiring extensive laboratory equipment and lengthy processing periods. A typical prior art system for dyeing photographic silver images required a multistep processing operation. First, the entire image bearing colloid layer would be bleached with a ferricyanide solution to form a silver complex. In general, these mordanting solutions were fairly acidic and also stained the non-image background area. Accordingly, the bleaching treatment was generally followed by extended immersion in a water rinse or similar clearing solution to remove the stain from the non-image background. Thereafter, the entire image area was bathed with a separate acidified dye solution to form a dyed mordant with the existing ferricyanide complex. The acidified dye solution would also stain the background (non-image) areas. Accordingly, the dyeing step was generally followed by a second extended rinsing operation to clear residual dye stains from the non-imaged area and in some instances a further acidic treatment followed again by washing.

In another prior art system for dye toning, the photographic silver image was converted into a halide or ferricyanide and then subsequently reconverted into another metal, e.g., copper, iron, uranium, by treatment with a complexing metal solution. Thus, the complex metal would replace the silver in the photographic image and serve as a mordant for a subsequent dye treatment.

Both of the preceding processes involve the use of an acidic constituent, either as part of the mordanting or dyeing solutions. As the photographic silver images to be treated were generally dispersed in gelatin or an equivalent hardenable hydrophilic colloid material, this often resulted in tenacious stains adhering to the non-image areas. Hence, the prior art systems tended to require extensive cleansing operations be undertaken following the dyeing procedure in an effort to remove these dye stains from the non-image areas. Use of these systems required a considerable amount of photographic equipment.

A further drawback to prior art dye-toning procedures was that they were relatively lengthy procedures. Thus, it might take an hour or more to dye a single photographic image.

As a consequence of the lengthy processing times, extensive equipment requirements, stain removal difficulties and the high cost, dye toning was largely abandoned by the photographic art in favor of in-situ photographic coloring systems. Nonetheless, dye toning remained an important tool for applying coloration to black and white photographic silver images. Over the past 20 years photographic silver image dye-toning operations have been largely confined to academic and industrial institutions which could afford to bear the expense of equipping and operating a laboratory for such systems.

The present invention provides a rapid system for dye toning photographic silver images requiring a minimum of equipment and instruction. Further advantages of the present system are the ability to produce dye-toned photographic silver images free from background staining and the ease and thoroughness with which excess dye solution may be removed from the non-image areas. Briefly summarized, the invention provides a method for dyeing preselected areas of a photographic silver image by contacting such areas with an aqueous dye-mordant solution having a pH of at least 7.5 for a predetermined time period and removing the dye from the non-image area with an aqueous alkaline solution having a pH of at least 7.5. Since the entire dyeing operation is carried out in the absence of acidic solutions there is little or no propensity to the formation of stain and the system repeatably yields brilliant dye images of high quality. The system is especially useful in dyeing photographic images obtained by means of black and white silver salt diffusion transfer reproduction although it may be employed to color both negative and positive photographic silver images embedded in hydrophilic carrier mediums and free from agents which might have a mordanting action toward the coloring dyes or harden the colloid.

Accordingly, one object of the present invention is to provide a rapid system for dye toning, black and white, positive and negative photographic silver images.

Another object of the present invention is to provide a simplified dye-toning system for photographic silver images requiring a minimum of equipment for operation.

A still further object of the present invention is to provide a dye-toning system in which dye stains may be removed from the background and non-image areas quickly and thoroughly.

Another aspect of the present invention is to provide a dye-toning system for photographic silver images in which the background (non-image) areas are rapidly freed from staining after the dyeing operation has been completed.

These and other objects of the present invention will be apparent upon consideration of the following detailed description.

DESCRIPTION OF THE PREFERRED EMBODIMENTS

The present invention is primarily concerned with the application of dyes to preselected areas of photographic silver images. Suitable photographic silver images for use in the invention are those generated by imagewise exposure of photographic silver halides embedded in colloid layers to actinic radiation. The silver halide layers can be any of the conventional negative or positive type developing emulsions. Typical silver halides include silver chloride, silver bromide, silver bromoiodide, silver chloroiodide, silver chlorobromoiodide and the like. Mixtures of more than one of the preceding silver halides may be employed and in accordance with the general practice such emulsions can contain spectral sensitizers, anti-fogging agents and similar ingredients. The photosensitive layers and/or image receiving layers may rest on those supports generally employed for photographic elements including, for example, paper, films of cellulose nitrate, cellulose ester, polystyrene, polyesters, polyethylene terephthalate and papers coated with resinous materials as, for example, with alpha-olefin polymers containing 2–4 carbon atoms as exemplified by polyethylene, polypropylene, ethylene-butene copolymers or the like as well as glass, metal plates or foils and similar photographic supports. The photographic silver halide constituent may be dispersed in natural or synthetic hydrophilic colloid binding materials generally employed for this purpose including, for example, gelatin, colloidal albumen, water soluble vinyl polymers, cellulose derivatives, acrylamide polymers, polyvinyl pyrrolidone and similar agents known in the art. A particularly preferred photographic silver image is obtained by means of a diffusion transfer reproduction process of the type in which an exposed silver halide emulsion is developed in the presence of a silver halide solvent such as sodium thiosulfate in contact with a receiving sheet with the result that a silver image is developed in the emulsion layer and thereafter the residual silver halide is dissolved by the silver solvent and transferred image-wise by diffusion to a receiving sheet where it is transformed to metallic silver or other silver compound of high optical density. The preceding processes have been described at length in the patent (e.g. Rott U.S. Pat. No. 2,352,014) and periodical literature and are well-known in the art.

The photographic silver images which are the starting point of the present invention are obtained as the result of image-wise exposure and development whereby the photographic silver halide products are converted to metallic silver images. Preferably, the colloid binder in which the photographic silver image is embedded should be free of any agent which might act as a mordant for the coloring dyes employed in the present invention. To this end, multivalent inorganic salts including those of aluminum, chromium, titanium, iron, vanadium and zirconium; gall compounds and other organic agents which harden colloid (e.g. gelatin) layers such as tannins (e.g., tannic acid), oxazolidines, dialdehyde starches and similar agents are preferably absent from the image-bearing colloid layer since the presence of these constituents can impart a mordanting quality to the colloid layer thereby resulting in the non-image areas becoming stained with the dye.

According to the method of the present invention a negative or positive black and white photographic silver image is prepared for the instant process by thoroughly washing the photographic silver image with water. The washing operation can be carried out by vigorously spraying cold water across the face of the photographic image for approximately 30 seconds to 1 minute.

In the event that a particular silver image was not adequately processed during photographic development to remove all traces of the photographic processing fluids (e.g. developers and/or fixer materials) from the finished image, the image may be prepared for dyeing by treatment with an alkaline preparation solution having a pH above 7.5. The preparation solution is an alkaline aqueous co-solvent mixture having a pH above 7.5 and preferably in the range pH 7.5 to 11.5. Suitable alkaline constituents for use in the preparation solution are those water soluble inorganic and organic alkaline agents which do not react adversely on photographic silver images, and include by way of non-limiting example, alkali metal sulfites such as sodium sulfite and potassium sulfite, alkali metal salts of erythorbic acid (e.g. sodium erythorbate) alkali metal carbonates such as sodium, potassium and lithium carbonate, alkali metal hydroxides, e.g. sodium hydroxide, potassium hydroxide, organic amines including guanidine carbonate, monoethanolamine, diethanolamine, and similar straight and branched chain alkanol amines having from 1 to 4 carbon atoms in the hydrocarbon chain. Also useful are alkaline ammonium compounds including by way of non-limiting example ammonium hydroxide, ammonium sulfite, ammonium carbonate, the ammonium salts of weak organic and inorganic acids, e.g. ammonium citrate, ammonium malonate; heterocyclic alkaline compounds including morpholines and their lower alkyl ($C_1$–$C_4$) and lower hydroxyalkyl ($C_1$–$C_4$) derivatives e.g. N-hydroxyethyl morpholines; piperidines including their lower alkyl ($C_1$–$C_4$) and lower hydroxyalkyl ($C_1$–$C_4$) derivatives. The alkaline moiety helps free the silver image and the colloid in which the image is embedded from the action of any materials which may yield dye mordanting contaminants and which may not have been removed in the course of developing the photographic silver halide image. Mordanting contaminants are those organic and inorganic agents such as oxidized developing agents, e.g. quinone and the like which may act as dye mordants in the non-image areas thereby imparting a background stain to the photographic image. Optional ingredients for the preparation solution can include surface active agents (surfactants) including anionic, non-ionic, and cationic compositions. Specific anionic surfactants found to be useful include the sulfated or sulfonated ethers of long and short chain aliphatic groups (e.g.: $C_{17}H_{33}$—O—$C_2H_4$—$SO_3$—$N_a$), or ($C_{17}H_{33}$—O—$C_2H_4$—O—$SO_3$—$N_a$) sulfonated alkyl esters of long chain fatty acids $$(C_{17}H_{33}-\overset{\overset{\displaystyle O}{\|}}{C}-C_2H_4-SO_3-N_a)$$

sulfonated glycol esters of long chain fatty acids $$(C_{17}H_{33}-\overset{\overset{\displaystyle O}{\|}}{C}-C_2H_4-O-SO_3-N_a),$$

sulfonated alkyl substituted amides of long chain fatty acids (e.g.

$$C_{17}H_{33}-\overset{\overset{\displaystyle O}{\|}}{C}-NH-C_2H_4-SO_3N_a),$$

alkylated aryl sulfonates (dodecyl benzene sodium sulfonate), hydro aromatic sulfonates (tetrahydronaphthalene sodium sulfonate), and alkyl sulfosuccinates (dioctyl sodium sulfosuccinate) alkyl sulfonates (e.g., dodecyl sodium sulfonate) alkyl sulfonates (e.g., dodecyl sodium sulfonate) alkyl sulfates (sodium olyel sulfate), and soaps such as sodium laurate, ammonium stearate and diethanol-ammonium oleate. Non-ionic surface active agents useful in the invention include monoethers of polyglycol with long chain fatty alcohols such as the reaction products of ethylene oxide or polyethylene glycol with long chain fatty alcohols, monoesters of polyglycols with long chain fatty acids including reaction products of ethylene oxide or polyethylene glycol with long chain fatty acids, partial esters of polyhydric alcohols with long chain monocarboxylic acids (glycerol monostearate, sorbitan trioleate), and partial and complete esters of long chain monocarboxylic fatty (and/or resinous) acids with polyglycol ethers or polyhydric alcohols (e.g., tristearate acid ester of polyglycol ether of sorbitan). Cationic surfactants useful in the present invention include quaternary ammonium salts in which one of the groups attached to the nitrogen has an aliphatic group having 8 or less carbon atoms (e.g., trimethyl acetyl ammonium halide. Especially preferred surfactants are dioctyl sodium sulfosuccinate (available from American Cyanamid Inc. as Aerosol OT and Aerosol OS) Saponin ($C_{32}H_{54}O_{18}$) and Tergitol NPX (alkyl aryl polyethylene glycols) (available from the Union Carbide Corporation). In many instances it is also desirable to include a rheological additive or thickener in the preparation solution to impart improved viscosity to the solution. For this purpose, polyethylene glycols (e.g., Carbowax 400 available from Union Carbide Corporation), polyvinyl pyrrolidone (available from General Aniline and Film Corporation) Avg. MW 40,000–160,000, and carboxymethyl cellulose may be employed.

Organic solvents, preferably those which are wholly or partly miscible with water, including normal and branched chain alkyl alcohols containing from 2–4 carbon atoms (e.g., ethyl, isopropyl alcohols), ketonic alcohols (e.g., diacetone alcohol), ether alcohols (e.g., monoethyl ether of diethylene glycol, methoxyethanol, cycic alcohols (e.g., tetrahydrofurfuryl alcohol), dioxane and, ketones, (e.g., acetone, methylethyl ketone), and heterocyclic solvents including morpholine, formyl piperdine), and lactams, (e.g., butyrolactone and pyrrolidones) are employed as adjuvants in the preparation solution of the present invention. The relative proportions of the constituents in the aqueous preparation solution is not critical provided the final preparation is an aqueous solution of flowable liquid having a pH above 7.5 and preferably in the range 7.5 through 11.5. Illustrative examples of preparation solutions which may be used in the present invention including the preferred formulation are presented in Table A.

TABLE A

| | | |
|---|---|---|
| I | SODIUM SULFITE | 5 to 10 g. |
| | ISOPROPYL ALCOHOL | 150 to 350 ml. |
| | SODIUM HYDROXIDE | 0.5 to 2.0 g |
| | SURFACE ACTIVE AGENT | |
| | 5% SAPONIN | 5 ml. |
| | WATER to make | 1000 ml. |
| II | POLYVINYL PYROLIDONE | 15 G. |
| | ETHYL ALCOHOL | 200 ml. |
| | SODIUM SULFITE | 7.0 G. |
| | GUANIDINE CARBONATE | 10.0 G. |
| | WATER to make | 1000 ml. |
| III | POLYVINYL PYRROLIDONE | 35 G. |
| | WATER | 600 ml. |
| | GUANIDINE CARBONATE | 8 G. |
| | SODIUM SULFITE | 8 G. |
| | Water to make | 1000 ml. |
| IV | ETHYL ALCOHOL | 50 to 150 ml. |
| | ISOPROPYL ALCOHOL | 100 to 300 ml. |
| | SODIUM SULFITE | 5 to 15 G. |
| | GUANIDINE CARBONATE | 5 to 15 G. |
| | Water to make | 1000 ml. |

The substrate bearing the silver image to be colored is flooded with or immersed in the preparation solution for a period of from about 30 seconds to 2 minutes at ambient (room) temperature. This time period is sufficient to desensitize any remaining mordanting contaminants and to deactivate any dye mordanting constituents which may have remained affixed to the silver image or in the colloid. The preparation solution is then removed by blotting with paper toweling, a cotton swab, Q-tip, sponge or other absorbent material.

Following either a thorough water washing and/or the preparation bath treatment, the photographic silver image is ready for the dyeing operation. In order to facilitate further consideration of the invention, the present system will be described with respect to dyeing preselected portions of a photographic silver image produced on a coated paper base with a diffusion transfer reproduction process as described in U.S. Pat. No. 2,751,300 Example 2 although it should be clearly understood that the invention is not limited to use in this fashion. Specifically, the invention will be described with respect to dyeing preselected area of a photographic silver image depicting the word "RECOGNITION" in block letters.

An important advantage of the instant system is that the dyeing and mordanting operations are carried on simultaneously by application to the image bearing substrate of a single processing solution. The coloring bath which is used to dye the photographic silver image is mixed just prior to use by admixing predetermined quantities of a dye bath and a mordanting solution. The dyeing operation is carried on by forming a mordanting complex from the metallic silver of the photographic image and one or more complexing agents carried in the coloring bath. The mordanting complex has an affinity for the dye present in the coloring bath.

The mordanting solution consists essentially of an aqueous alkaline solution of one or more complexing agents which will form an insoluble stable salt complex with the metallic silver of the photographic image. Suitable complexing agents are water soluble compounds which function as oxidizing agents under aqueous alkaline conditions such as alkali metal ferricyanides (e.g. potassium ferricyanide). The foregoing oxidizing agents may optionally be used in conjunction with complexing adjuvants, e.g. sodium thiocyanate, water soluble halogens (e.g. iodine, chlorine or bromine), alkali metal salts of near neutral pH (pH 6.5–7.5), including halogen salts, e.g. chlorides (sodium chloride), bromides, iodides (potassium iodide), sulfate (e.g. potassium sulfate), or nitrates (e.g. sodium nitrate) either singly or together with each other and which will, together with the oxidizing agent, form a complex with the silver image. The complex oxidizing agents are generally present in the form of their alkali metal salts, preferably the sodium, potassium or lithium salts, potassium ferricyanide being the preferred complexing and oxidizing agent for use in the invention. In most instances, the mordanting solution will contain from about 8 to about 20% and preferably from about 10 to about 15% by weight of the complexing agent. In addition to the complexing agent, the mordanting solution will also preferably contain from about 0.1 to about 5% by weight of iodine. The iodine can be added to the aqueous mordanting solution either as an alkali metal iodide salt (preferably potassium iodide) which is oxidized to elemental iodine by the ferricyanide in one embodiment of the invention, or preferably in the form of an elemental iodine solution in an aqueous or organic solvent miscible with water (e.g., iodine in acetone). Although the iodine can be added to the aqueous solution in the form of potassium iodide, any soluble, colorless, alkali metal iodide salt may be employed in the invention.

The mordanting solution also contains an alkaline material to bring the solution to a pH above 7.5 and preferably in the range pH 7.5 to 11.5. In the preferred embodiment of the invention, the mordanting solution contains excess alkaline material in the event that the dye bath may be carrying a small quantity of acidic reactant. Since most dyes are commercially available in the form of their acid salts, the excess alkali in the mordanting solution insures that the final processing bath used to color the photographic silver image is within the alkaline pH range in which the present invention will operate. The water soluble organic and inorganic alkaline constituents of the mordanting solution may be selected from amongst those employed in formulating the preparation solution. Laboratory trials consistently show that operation of the invention above pH 11.5 and below pH 7.5 does not provide satisfactory dyeing conditions.

Optionally, a rheological control agent or thickener of the type employed in conjunction with the preparation solution may also be utilized in the mordant solution.

It has been found that the alkaline nature of the mordanting solution will bring dyes present in the dye bath into alkaline conditions and maintain them in their soluble form as opposed to the flocculated precipitate which often occurs when dyes are removed from an acid environment.

The rheological control agent assists in maintaining the combined mordanting-dye solution which is applied to the photographic silver image in stable condition for several hours by preventing flocculation of the dye and its precipitation from the solution. The level of iodine in the mordanting solution is intentionally kept low because iodine stains gelatin and many hydrophilic colloids. The instant process does not require the presence of a relatively high level of iodine in the mordanting solution, as a stable complex is formed with the elemental silver of the photographic image and the complexing agent of the invention. Accordingly, approximately from about 0.1 to 5% of iodine is required in the mordanting solution. The preparation of the mordanting solution is accomplished by combining the complexing agent, iodine and optical constituents in the desired quantities with a sufficient amount of water to bring them into solution and within the range pH 7.5 to 11.5. Several suitable mordanting solutions including the preferred formulation with polyvinyl pyrrolidone are illustrated in Table B.

TABLE B

| | | |
|---|---|---|
| I | POTASSIUM FERRICYONIDE | 90 to 150 G. |
| | POTASSIUM IODIDE | 0.1 to 4.5 G. |
| | POTASSIUM CARBONATE | 5 to 10 G. |
| | WATER TO MAKE | 1000 ml. |
| II | POTASSIUM FERRICYANIDE | 90 to 150 G. |
| | 3% IODINE SOLUTION IN ACETONE | 75 to 150 ml. |
| | POTASSIUM CARBONATE | 5 to 10 G. |
| | WATER TO MAKE | 1000 ml. |
| III | POTASSIUM FERRICYANIDE | 90 to 150 G. |
| | 3% IODINE IN ACETONE | 75 to 150 ml. |
| | GUANIDINE CARBONATE | 5 to 19 G. |
| | WATER TO MAKE | 1000 ml. |
| IV | PREFERRED | |
| | POLYVINYL PYROLIDONE | 35 G. |
| | POTASSIUM FERRICYANIDE | 124 G. |
| | 3% IODINE SOLUTION IN ACETONE | 100 ml. |
| | GUANIDINE CARBONATE | 10 G. |
| | WATER TO MAKE | 1000 ml. |

The mordanting solution is prepared in advance and held separately until just prior to admixture with the dye bath.

The dyes which may be used in the present invention are those dispersible in aqueous and organic solvents and include those generally classified as basic dyes as well as those acid dyes free from sulfonic groups and which have an affinity for the mordanting complex of this invention. Diazo dyes containing only the carboxylic group as the acidulating factor may be employed in the invention. In addition, the dyes must be capable of being mordanted under the alkaline conditions of the invention and remain insoluble in the mordanted condition. It will be appreciated that since the mordanting and dying reactions are taking place simultaneously in the same solution, only those dyes which can be mordanted under alkaline conditions may be employed successfully in the present invention. A non-limiting example of the dyes which may be employed in preparing the dye baths of the present invention is found in Table C.

TABLE C

| BASIC DYES GENERIC STRUCTURES | TRADE NAME | SPECIFIC IDENTIFICATION | COLOR |
|---|---|---|---|
| DIPHENYMNENTHANE | | AURAMINE CI 41000 | YELLOW |
| TRIPHENYLMETHANE | BASIC GREEN # 4 | MALACHITE GREEN CI 42000 | GREEN |
| | BASIC BLUE # 11 | VICTORIA BLUE R CI 44040 | BLUE |
| | BASIC VIOLET # 1 | METHYL VIOLET 2B CI 42535 | VIOLET |
| | BASIC RED # 9 | BASIC FUCHSIN CI 42500 | RED |
| | | ROSANILINE CI 42510 | RED |
| ACRIDINE | | ACRIDINE YELLOW CI 46025 | YELLOW |
| OXAZINE | BASIC BLUE # 12 | NILE BLUE A CI 51180 | BLUISH |
| THIAZINE | BASIC YELLOW | THIOFLAVINE T CI 49005 | YELLOW |
| | | TOLUIDINE BLUE CI 52040 | BLUE |
| | BASIC BLUE # 9 | METHYLENE BLUE CI 52015 | BLUE |

TABLE C-continued

| BASIC DYES GENERIC STRUCTURES | TRADE NAME | SPECIFIC IDENTIFICATION | COLOR |
|---|---|---|---|
| AZINE | BASIC RED # 2 | SAFRANINE O CI 50240 | RED |
| DIAZO | CHRYSOIDINE Y | MONO-DIAZO COUPLED DYE CI 11270 | YELLOW |
| ACID DYES | | | |
| RHODANINE | | RHODAMINE BX | SCARLET |
| | | PATENT BLUE A | GR BLUE |
| DIAZO | | METHYL RED | YELLOW |

In addition to the dyes which are generally present at a level of from about 0.001% to 1%, the dye baths may also contain one or more organic solvents for the dye which are miscible with water and one of the rheological additives utilized in the preparation solution.

The particular solvents used in the dye bath depend upon the nature of the dyes in the bath, and diphenyl and triphenyl methane dyes generally being soluble in lower alcohols such as methanol. The organic solvents which may be used in the dye bath are preferably water miscible and must be at least partially water miscible. 1-formyl piperdine has been found to be especially useful as a dye solvent in the present invention. Generally, the solvents indicated to be useful in conjunction with the Preparation solution may be employed in formulating the dye baths of this invention.

Preferably, the dye bath solution will contain from about 0.005% to about 1.0% dye. The quantity of dye in a particular solution is varied according to the tinctatorial strength of the particular commercial dye batch from which the bath is being prepared and according to the color intensity desired by the operator on the finished image. The dye bath may optionally contain from about 5 to about 25% of an organic solvent which is at least partially water miscible and from about 1 to about 10% by weight of a rheological additive or surfactant which may be selected from amongst those employed in formulating the Preparation solution. The amount of organic solvent used in preparing a dye bath will vary from one dye to another. This is believed to be attributable to the manner in which different batches of the same dye are prepared by commercial manufacturers. Accordingly, to facilitate removal of a particular dye stain from the background (non-image) area it is often necessary to utilize increased levels of solvent or mixtures of the solvents mentioned in the invention. For example, the tendency of malachite green dyes to form tenacious stains is overcome by employing up to 30% by weight of isopropyl alcohol in preparing a bath containing this dye. The particular solvent to be added to a given dye bath may be selected by the operator from amongst the solvents enumerated herein in connection with the preparation bath. Rheological agents and surfactants selected from amongst those employed in the Preparation solution may also be employed in the dye bath. The dye baths of the invention are mixed in advance and held in separate containers for admixture with the mordanting solution just prior to use in the process of the invention. Several typical dye baths are illustrated in Table D.

TABLE D

| | | |
|---|---|---|
| I | PREFERRED | |
| | WATER | 600 ml. |
| | POLYVINYL PYROLIDONE | 25 G. |
| | DIACETONE ALCOHOL | 60 ml. |
| | 1-FORMYL PIPERIDINE | 65 ml. |
| | DYE ACCORDING TO TINCTATORIAL STRENGTH | 0.005 to 1.0% BY WT. |
| | WATER TO MAKE UP TO | 1000 ml. |
| II | "CARBOWAX" 4000 | 8 to 20 G. |
| | WATER | 600 ml. |
| | ISOPROPYL ALCOHOL | to 35% |
| | DIACETONE ALCOHOL | to 15% |
| | DYE ACCORDING TO TINCTATORIAL STRENGTH | 0.005 to 1.0% BY WT. |
| | WATER TO MAKE | 1000 ml. |
| III | METHYL CELLUSOLVE | 15 ml. |
| | ISOPROPYL ALCOHOL | 150 ml. |
| | DYE ACCORDING TO TINCTATORIAL STRENGTH | 0.005% to 1.0% By Wt. |
| | WATER TO MAKE | 1000 ml. |

A further advantage of the processes and compositions of this invention is that they provide the operator with the ability to admix various dyes at the time of their application to the photographic image in order to obtain specific coloration effects in the finished product. In addition, it is possible by the present invention to vary the intensity of a particular dye to some extent by using the mordanting solution as a diluent for a specific dye bath. Thus, the invention affords complete coloring flexibility to the operator and enables this freedom of operation to be practiced at the time of applying the dye to the photographic image. This in turn permits easy adjustment of coloration and the concommitant availability of a wide range of color tones and hues from a fundamental group of dye colors.

Just prior to use in dyeing a photographic silver image, approximately equal amounts of the mordanting solution and a particular dye bath are admixed together in a small container. It will be appreciated by those skilled in the art that the concentration of either the mordanting solution or the respective dye baths to be employed in the invention may be adjusted at the time of its preparation in order to permit the operator to employ equal amounts of each in preparing the processing solution which is to be applied to color the photographic silver image. However, the combined dye-mordanting solution must have a pH of at least 7.5 and preferably in the range pH 7.5–11.5. To accomplish this objective, it may be necessary to admix an excess quantity of the mordant solution with the dye bath in those instances where the dye both is somewhat acidic in nature. Accordingly it should be understood that the pH of the combined dye-mordant solution can be adjusted to fall within the proper alkaline range by regulating the quantity of mordanting solution which is added to a particular dye bath. Thus, a separate color processing solution will be prepared for each dye color which is to be applied to the image by combining appropriate quantities of dye bath and mordanting solution. This permits an operator to color one segment of a photograpahic image (e.g., the letters "REC" in the word RECOGNITION) in a first color and another portion of the same word (e.g., the letters "OGNI") in a second color. It will be appreciated that each dye bath is preferably prepared beforehand so that it may be combined with approximately equal volumes of the mordanting solution prepared for use in the invention. In such case the operator can combine equal volumes (e.g., a few milliliters) of mordanting solution and dye bath in the first color (e.g., yellow) in a separate container. The contents are admixed to form the combined color processing solution which is applied to preselected portions of the photograph, for example to color the garments on the arms and legs of a figure shown in the image. Application of the coloring solution (or any of the other processing fluids of the invention) can be by way of a Q-tip, sponge, cotton ball, paint brush or similar implement which will permit the operator to generously bathe the desired image area with the color processing solution. In the event the area to be dyed with the first color is adjacent to other silver image areas which are to be treated with different dye colors, the latter areas of the photographic image may be masked off using artists' drafting tape, a Mylar shield, or similar fluid impervious masking materials. The admixture of the dye bath and mordanting solution to form the color processing solution can be made in a small paper cup, glass beaker, or even on a water color palette of the type employed by artists. The quantity of processing fluid prepared is based on the size of the photogrpahic image area to be dyed, although in most instances from about five to about twenty ml. is sufficient. The premixed processing fluid can be generously applied to the image lines and areas which are to be colored and no care need be taken to prevent the fluid from spilling over onto the background areas of the photographic print, e.g., those portions which do not bear a silver image. Generally, the premixed coloring fluid is allowed to remain on the image area for a period of about a minute or so during which time the excess fluid is gently swabbed or agitated back and forth across the areas to be processed using the same implement previously employed to apply the solution to the image area. This agitation technique aids in insuring that a uniform coloration is imparted to the preselected image area. After the image has been immersed for about a minute or so, the excess fluid is removed by blotting with paper toweling, cotton or cloth wads, a sponge, or similar absorbent, non-abrasive material.

At this point, a fixing solution is generously applied to the previously treated area in which the silver images no longer appear black, but instead bear the coloration imparted by the color processing solution. The fixing bath which is applied to those areas of the substrate treated with color processing fluid is an aqueous alkaline solution containing from 10 to about 50% and preferably 20–40% of an organic solvent which is at least partially water soluble, and having a pH above 7.5 and preferably in the range pH 7.5 to 11.5. Suitable fixer solutions are substantially identical to the alkaline solution first applied to prepare the image to receive dye coloration and may contain the same constituents except that the fixer solutions must include 10–50% of an organic solvent which is at least partially water miscible, and preferably include from about 0.5 to 5% of a colorless alkali metal iodide to assist in stabilizing the mordanted dye complex. The presence in the fixer bath of the alkali metal iodide, preferably potassium iodide, also serves to brighten the mordanted dyes and to render them more transparent. Achieving a light transmitting mordanted dye is of great importance in those instances where the dyed photographic image is to be used as a transparency to be illuminated with an overhead projector or similar projection device. The preferred fixer solution of the invention includes an inorganic alkali metal salt of a reducing agent, and is preferably one containing a sulfite ion (e.g., sodium or potassium sulfite) as one alkaline constituent of the fixer solution. As in the case of the Preparation, mordanting, and dye baths of the invention, the relative proportion of ingredients in the fixer solution to one another is not critical except that the solution should comprise from about 0.5 to about 5% by weight of the iodide constituent, must contain from about 10 to about 50% by weight of a hydrocarbon solvent which is at least partially water miscible and must have a pH no lower than 7.5 and preferably in the range pH 7.5 – pH 11.5. Application of the alkaline fixer solution is made to the image areas which are generally still moist from the previous dyeing solution. The iodide constituent of the fixer is believed to form a complex with the dyed mordant thereby rendering it more transparent and intense. The fixer solution also acts to solubilize any unmordanted dye and bring it into solution. Accordingly, the fixer solution simultaneously renders the dye mordanted portions of the image more transparent and creates an alkaline condition which will assist in rapidly removing dyes from the background or non-image sites on the photographic substrate. It is important that the fixer solution maintain the alkaline condition imposed throughout the earlier steps in the dyeing procedure and accordingly the fixer solution has a pH of at least 7.5 and preferably in the range 7.5 through 11.5.

Table E contains several non-limiting examples illustrating fixer solutions which may be employed in practicing the process of the present invention.

TABLE E

| | | |
|---|---|---|
| I | (PREFERRED) | |
| | POLYVINYL PYROLIDONE | 14 G. |
| | WATER | 600 ml. |
| | ISOPROPYL ALCOHOL | 200 ml. |
| | POTASSIUM IODIDE | 8 G. |
| | SODIUM SULFITE | 8 G. |
| | GUANIDINE CARBONATE | 8 G. |
| | WATER TO MAKE TO | 1000 ml. |
| II | CARBOWAX 400 | 10 G. |
| | WATER | 600 ml. |
| | ISOPROPYL ALCOHOL | 100 ml. |
| | ETHYL ALCOHOL | 50 ml. |
| | METHYL CELLOSOLVE | 20 ml. |
| | POTASSIUM IODIDE | 4 to 10 G. |
| | SODIUM SULFITE | 4 to 10 G. |
| | MONOETHANOLAMINE 10 ml. | |
| | WATER TO MAKE TO | 1000 ml. |
| III | WATER | 600 ml. |
| | ISOPROPYL ALCOHOL | 150 to 300 ml. |
| | Potassium Sulfite | 4 to 8 G. |
| | POTASSIUM CARBONATE | 4 to 15 G. |
| | WATER TO MAKE TO | 1000 ml. |

The following example is included to facilitate a further understanding of the invention.

EXAMPLE I

A diffusion transfer reproduction on an 8 inch × 10 inch diffusion transfer substrate of the word "RECOGNITION" in capital letters was prepared acording to Example 2 of U.S. Pat. No. 2,751,300 and the resulting print allowed to dry. The image portion of the print consisted solely of the word "RECOGNITION" appearing in black letters against a clean white background.

A preparation solution was prepared by admixing 35 grams of polyvinyl pyrrolidone, 8 grams of sodium sulfite, and 8 grams of guanidine carbonate in 600 milliliters of water at room temperature. After the solids were dissolved additional water was added to bring the total solution to 1,000 ml. This solution had a pH in the range 7.5–11.5. Approximately 20 ml. of this solution was swabbed across the face of the diffusion transfer print for about 1 minute using a cotton pad.

A mordanting solution was prepared by admixing 100 grams of potassium ferricyanide, 100 ml. of a 3% iodine solution in acetone, 15 grams of guanidine carbonate and 25 grams of polyvinyl pyrrolidone in 750 ml. of water at room temperature. After the solids were dissolved a sufficient amount of water was added to make 1000 ml of solution.

Three dye baths were prepared by admixing the ingredients in water and solvent at room temperature according to the following formulation:

| DYE BATH | |
|---|---|
| Polyvinyl pyrrolidone (M.W. 40,000) | 25 grams |
| Diacetone alcohol | 50 ml |
| 1-formyl piperdine | 60 ml |
| 0.1 gm Auramine Yellow (C.I. 41000) + 1.0 gm Acridine Yellow (C.I. 46025) | |
| water to make | 1000 ml |

Separate 1000 ml baths were prepared in the same fashion using 2.0 gm basic blue #9 (methylene blue color index 52015) and 0.7 basic red #2 (safranine O color index 50240) as the respective dye in each instance, the dyes provided a vivid intense coloration to the dye bath.

After resting on the image surface for about one minute, the preparation fluid was soaked up by blotting the image with paper toweling and the print allowed to dry.

While the print was drying, approximately 10 ml of the yellow dye bath was combined with an approximately equal quantity of the mordanting solution in a small glass beaker to form a coloring solution having a pH within the range 7.5–11.5 and the mixture agitated with an artist's fine tip paint brush. A fluid impermeable Mylar mask was laid down over the word "RECOGNITION" except the letters "REC" which remained exposed. The fine tip paint brush was used to apply about 5 ml of the premixed yellow coloring fluid over the exposed substrate area bearing the letters "REC". Application of the fluid was not limited to the imaged letter areas and the fluid was also applied onto the background area as well by moving the brush back and forth across the letters "REC" and the intervening non-image areas. After about one minute of swabbing action and dye processing solution was removed from the substrate by blotting with a paper towel. The letters "REC" appear in a clear yellow color. The background areas appeared lightly pigmented in a yellow tone although the white background was clearly visible through the coloration. Thereafter, about 10 ml of a fixer solution having a pH in the range 7.5–11.5 prepared by admixing 14 grams of polyvinyl pyrrolidone, 200 ml. isopropyl alcohol, 8 grams potassium iodide, 8 grams sodium sulfite, and 8 grams of guanidine carbonate in 600 ml. of water to dissolve the solid ingredients and then adding water to make 1,000 ml. was generously applied to the previously treated area. The fixer solution was agitated back and forth across the treated area for approximately about 1 minute after which time it was removed with blotting paper to leave the letters "REC" colored in brilliant yellow and the background (non-image areas) clean white and free from stain.

After the print has dried, the mask was moved to expose only the letters "OGN". These letters were dyed blue by combining about 10 ml. of the blue dye with an approximately equal amount of the mordanting solution in a separate beaker and applying about 5 ml. of the resulting blue color processing solution to the substrate with a paint brush. The processing solution had a pH within the range 7.5–11.5. No further treatment of this area with the preparation solution was required. After approximately 1 minute the excess fluid was removed by blotting with paper toweling and the treated area swabbed with a liberal amount of the previously prepared fixer solution. After 1 minute the fixer solution was removed by blotting to reveal the letters "OGNI" colored in blue with the background clear and stainfree. After drying, the same procedure was again repeated to color the remaining letters of the word (i.e. "TION") in red by applying about 5 ml of a coloring solution (prepared by admixing approximately 10 ml of the red dye bath with an approximately equal amount of the mordanting solution in a separate beaker) to the substrate area including the exposed letters and thereafter applying a liberal quantity of fixer solution in the same manner as before.

At the conclusion of this procedure the diffusion transfer photograph of the word "RECOGNITION" in which the letters were originally black on a white background was converted to a colored image in which the letters "REC" were yellow, the letters "OGNI" were blue, and the letters "TION" red.

EXAMPLE II

The same procedure was repeated as in Example I, except that the word RECOGNITION was produced as a positive photographic silver image on a transparent polyester film base. The image bearing substrate was treated with Preparation solution, dried, and the letter groups REC, OGNI and TION respectively masked off, coated with yellow, blue and red dyes, treated with fixer solution and dried in the same manner as in Example I. The transparent (non-image) areas of the film base remained free of any dye coloration or staining after the final treatment with fixer solution. The color bearing image areas were optically light transmitting and appeared translucent when held up to a 100 watt incandescent light bulb.

It will be understood by those skilled in the art that the above examples are presented by way of illustrating preferred embodiments of the invention which is not limited to operation in this fashion. In general, the proportions of ingredients to one another in the baths and solutions of the invention is not critical and the process will operate in a satisfactory fashion provided that the alkaline pH range of 7.5–11.5 is maintained and the respective ingredients are dissolved in the solution. The preceding examples illustrate the manner of operating the invention with a minimum amount of equipment. However, the instant dye coloring system may also be carried out in trays, on automatic processing machines in which a moving film web is transported by means of rollers from one bath to another, in photographic developing tanks and similar processing apparatus. The quantity of dye employed in preparing the respective dye baths for use in the invention may be varied to a considerable extent according to the tinctatorial strength of a particular dye and the degree of coloration sought to be obtained in the finally colored image. It is also possible to combine different dyes in a given dye bath to achieve a wide variety of coloration and hue.

In most instances stain removal ability can be enhanced by raising the pH of the fixer solution. Generally, the fixer solution should be prepared with an excess of the alkali constituent in order to avoid staining of the background (non-image) areas. In general, as the amount of alkali is increased in the fixer solution, the solution's ability to remove dye stains from the background area is increased. Similarly, the mordanting solution should also contain a stoichiometric excess of alkali to counteract the acidic nature of certain dye formulations.

The fixer solution alters the structure of any remaining unmordanted dye and renders it more soluble in the solution. For instance, diphenylmethane and triphenylmethane dyes are converted into their carbinol forms, while thiazine and acridine dyes are generally more soluble under alkaline conditions.

The quantity of mordanting solution required to be admixed with each particular dye bath may vary. As a general rule, the invention will operate if a sufficient amount of mordant solution is admixed with a given dye bath to insure that the combined fluid admixture has a pH above 7.5 and preferably in the range 7.5 through 11.5.

To further facilitate operation of the invention, 8 or 10 dye baths may be prepared in advance and held separately from one another in stoppered glass bottles. Similarly, the Preparation, Fixer and Mordanting solutions may also be prepared in advance and stored in separate, stoppered, glass bottles. In operaton, a particular dye bath may be admixed with an appropriate quantity of mordanting solution just prior to use, to form the color processing solution of the inventon. It has been found that the color processing solutions formed by admixing the dye bath and the aqueous mordanting solutions are stable for periods up to 4 hours or more, thus enabling the same bath to be used in coloring several photographs.

Accordingly, the present invention will be seen to provide a rapid technique for imparting permanent colors to preselected image areas of a photographic silver image in which the dye color is taken up preferentially by the imaged areas and any excess dye easily removed from the non-imaged (background) areas of the photographic substrate. This system is especially useful in conjunction with negative and positive images produced by photographic diffusion transfer reproduction.

What is claimed is:

1. A method of dye toning a metallic silver image on a photographic substrate which comprises contacting the image bearing surface of said substrate with an aqueous solution having a pH in the range 7.5 to 11.5 for a predetermined time period, removing said aqueous solution from said substrate, admixing an aqueous mordant solution having a pH in the range 7.5 to 11.5 and containing potassium ferricyanide and iodine with an aqueous colorant solution containing an effective amount for coloring an image area of said substrate of a preformed water dispersible dye selected from the group consisting of diphenylmethane, triphenylmethane, acridine, oxazine, thiazine, diazo, azine and rhodamine dyes which can be mordanted to a complex formed from said potassium ferricyanide, metallic silver and said iodine under aqueous alkaline conditions to yield a color processing solution having a pH in the range 7.5–11.5, applying said processing solution to a preselected portion of said substrate containing said metallic silver image and a background area for a predetermined time period, removing said color processing solution from said substrate, contacting the portion of said substrate treated with said color processing solution with an aqueous fixer solution having a pH of at least 7.5 and containing from about 10 to about 50% by weight of an organic solvent which is at least partially water soluble and at least 0.5% by weight of an alkali metal iodide, removing said fixer solution from said substrate, and drying said image bearing substrate.

2. The method of claim 1 which comprises admixing a sufficient quantity of said mordant solution with said coloring solution such that said colorant solution has a pH of at least 7.5.

3. A method of coloring preselected image areas of a metallic photographic silver image on a substrate which comprises applying to said preselected metallic silver image area a color processing solution having a pH in the range 7.5 to 11.5 and containing iodine, alkali metal ferricyanide, and an effective amount for coloring said image area of a preformed dye colorant selected from the group consisting of diphenylmethane, triphenylmethane, acridine, oxazine, thiazine, azine, diazo and rhodamine dyes which can be mordanted under aqueous alkaline conditions whereby a mordanting complex is formed from the metallic silver of the photographic image, said iodine, and said alkali metal ferricyanide, said mordanting complex having an affinity for said dye colorant.

4. The method of claim 3 which comprises treating said preselected image area on said substrate with an aqueous alkaline fixer solution containing an organic solvent and an alkali metal iodide to remove dye colorant which has not been mordanted to said mordanting complex from the non-image areas of said substrate.

5. The method of claim 4 which comprises maintaining said dye colorant and said iodine in separate solutions and combining said dye colorant solution and said iodine containing solution to form said color processing solution just prior to applying said color processing solution to said image area.

6. The method of claim 5 wherein said dye colorant is a basic dye.

7. The method of claim 5 wherein said dye colorant is an acid dye containing a carboxylic acid group as the acidulating function.

8. The method of claim 5 wherein said dye colorant is at least partially soluble under aqueous alkaline conditions and insoluble in aqueous solutions under alkaline conditions after mordanting to said image.

9. The method of claim 8 wherein said fixer solution contains an alkali metal iodide salt.

10. The method of claim 9 wherein said alkali metal salt is potassium iodide.

11. The method of claim 9 wherein said alkali metal iodide is sodium iodide.

12. The method of claim 9 which comprises contacting the entire image bearing surface of said substrate with an aqueous preparation solution having a pH of at least 7.5 before applying said color processing solution to said photographic silver image.

13. The method of claim 12 wherein said iodine containing solution has a pH of at least 7.5.

14. The method of claim 13 wherein said iodine complexing agent solution includes potassium ferricyanide.

15. The method of claim 14 which comprises masking a portion of said substrate to isolate the underlying substrate from said color processing solution and leaving said preselected image area exposed, applying said coloring solution to said exposed image area on said substrate, removing said processing solution from said exposed area after a predetermined time period, immersing said exposed area with said fixer solution for a predetermined time period, and removing said fixer solution from said preselected area.

16. A composition for dye toning a photographic metallic silver image which comprises an aqueous color processing solution having a pH in the range 7.5 to 11.5 and containing iodine, a ferricyanide complexing agent and an effective amount for coloring said silver image of a preformed water dispersible dye colorant selected from the group consisting of diphenylmethane, triphenylmethane, acridine, oxazine, thiazine, diazo, azine and rhodamine dyes which can be mordanted under alkaline conditions to a complex formed from said ferricyanide complexing agent, said metallic silver image and said iodine, said preformed dye colorant having an affinity for said complex.

17. A composition according to claim 16 wherein said complex forming agent comprises an oxidizing agent.

18. A composition according to claim 17 wherein said complexing agent is iodine and a member selected from the group consisting of an alkali metal ferricyanide and an alkalai metal thiocyanate.

19. A composition according to claim 18 wherein said color processing solution contains at least 0.001% by weight of said dye, and said dye is dispersible in aqueous and organic solvents, free of sulfonic groups and insoluble in aqueous alkaline solutions when mordanted with a substance formed with silver, iodine, and said complexing agent.

20. The composition of claim 19 wherein said dye is a triphenylmethane dye.

21. A composition for coloring photographic metallic silver images which comprises an aqueous coloring solution having a pH in the range 7.5 to 11.5 formed by mixing a first aqueous alkaline solution containing iodine and an alkali metal ferricyanide complexing agent, with a second aqueous solution of a preformed water dispersible dye colorant selected from the group consisting of diphenylmethane, triphenylmethane, acridine, oxazine, thiazine, diazo, azine, and rhodamine dyes which can be mordanted under aqueous alkaline conditions to a complex formed from said iodide, said silver and said complexing agent.

22. The composition of claim 21 wherein said coloring solution has a pH in the range 7.5 through 11.5.

23. The composition of claim 22 wherein said agent comprises potassium ferricyanide.

24. The composition of claim 22 wherein said dye is a triphenylmethane dye.

25. The composition of claim 22 wherein said agent comprises potassium thiocyanate.

26. The composition of claim 23, wherein said dye solution contains a water miscible organic solvent.

* * * * *